US011781318B2

(12) United States Patent
Tanaka et al.

(10) Patent No.: US 11,781,318 B2
(45) Date of Patent: Oct. 10, 2023

(54) CEILING PANEL

(71) Applicant: PANASONIC INTELLECTUAL PROPERTY MANAGEMENT CO., LTD., Osaka (JP)

(72) Inventors: Koya Tanaka, Hyogo (JP); Yoshihiro Okada, Osaka (JP); Tatsuji Ono, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 182 days.

(21) Appl. No.: 17/434,265

(22) PCT Filed: Jan. 30, 2020

(86) PCT No.: PCT/JP2020/003459
§ 371 (c)(1),
(2) Date: Aug. 26, 2021

(87) PCT Pub. No.: WO2020/174999
PCT Pub. Date: Sep. 3, 2020

(65) Prior Publication Data

US 2022/0136243 A1 May 5, 2022

(30) Foreign Application Priority Data

Feb. 28, 2019 (JP) ..... 2019-035241

(51) Int. Cl.
*E04B 9/04* (2006.01)
*E04B 9/24* (2006.01)

(52) U.S. Cl.
CPC ..... *E04B 9/0435* (2013.01); *E04B 9/245* (2013.01); *E04B 9/248* (2013.01)

(58) Field of Classification Search
CPC ..... E04B 9/0435; E04B 9/245; E04B 9/248; E04C 2/30; E04F 13/12
See application file for complete search history.

(56) References Cited

U.S. PATENT DOCUMENTS 4,091,588 A * 5/1978 Heirich ..... E04D 3/363 52/522
4,437,287 A * 3/1984 Halfaker ..... E04B 9/045 52/145

(Continued)

FOREIGN PATENT DOCUMENTS

CN 1285019 A 2/2001
DE 10157246 C1 * 6/2003 ..... E04C 2/08

(Continued)

OTHER PUBLICATIONS

International Search Report and Written Opinion issued in International Patent Application No. PCT/JP2020/003457, dated Mar. 24, 2020; with partial English translation.

(Continued)

*Primary Examiner* — Adriana Figueroa
(74) *Attorney, Agent, or Firm* — McDermott Will & Emery LLP

(57) ABSTRACT

A ceiling panel of which both end portions in a second direction are held on a ceiling base having a long shape extending in a first direction and being provided in parallel spaced in a second direction the ceiling panel includes a panel body, a hooked portion, and a hooking portion. The hooking portion has a folded part formed by being bent into a room side from a tip end portion in an extending direction of an extension portion extending outward in the first direction from the second end portion in the first direction, and by being further folded inward in the first direction, and the hooked portion keeps hooking and holding of the folded part with a second end portion in the first direction of an (Continued)

adjacent ceiling panel to be provided in the first direction being positioned upward further than the first end portion in the first direction.

10 Claims, 6 Drawing Sheets

(56) References Cited

U.S. PATENT DOCUMENTS 4,736,564 A * 4/1988 Gailey ..... E04B 9/28
52/506.07
6,314,698 B1 * 11/2001 Johansson ..... E04B 9/0485
52/542

FOREIGN PATENT DOCUMENTS

| | | | | |
|---|---|---|---|---|
| FR | 2453353 | A1 | * | 10/1980 |
| JP | H03-047319 | U | | 5/1991 |
| JP | H10-299162 | A | | 11/1998 |
| JP | 2014-105569 | A | | 6/2014 |
| KR | 20100052242 | A | * | 5/2010 |

OTHER PUBLICATIONS

Chinese Office Action with English translation of Search Report dated May 7, 2022 issued in the corresponding Chinese Patent Application No. 202080016278.1.

* cited by examiner

CEILING PANEL

CROSS-REFERENCE OF RELATED APPLICATIONS

This application is the U.S. National Phase under 35 U.S.C. § 371 of International Patent Application No. PCT/JP2020/003459, filed on Jan. 30, 2020, which in turn claims the benefit of Japanese Application No. 2019-035241, filed on Feb. 28, 2019, the entire disclosures of which Applications are incorporated by reference herein.

BACKGROUND OF THE INVENTION

Field of the Invention

The disclosure relates to a ceiling panel constituting a ceiling of a building.

Description of the Related Art

Conventionally known is a ceiling panel which is constructed such that the end portion is directly fixed to an ordinary ceiling base such as a ceiling joist with a screw or the like. Such a ceiling panel is required to be screwed with the ceiling panel entirely held from below.

For example, the following Patent Literature 1 discloses a panel having an engagement portion at one end portion of a decorative portion and a receiving portion to be fixed to a ceiling joist at the other end portion of the decorative portion with a screw. The panels adjacent to each other are moved in the horizontal direction relative to the panel fixed to the ceiling joist, the engagement portion of the panel is fitted in a concave groove of the receiving portion of the panel which has already been fixed to the ceiling joist, and the receiving portion of the other end is fixed to the ceiling joist, thereby attaching the panel.

CITATION LIST

Patent Literature

PTL 1: Japanese Unexamined Patent Application Publication No. 2014-105569

SUMMARY OF THE INVENTION

Problems to be Solved by the Invention

The panel disclosed in the above-mentioned Patent Literature 1 is required to be moved horizontally relative to the panel which has already been fixed to the ceiling joist while holding the panel from below, and the panel is required to be screwed, thereby further improvement is expected.

The present invention is proposed in view of the above-mentioned problems and provides a ceiling panel capable of improving the workability.

Means of Solving the Problems

In order to achieve the above-mentioned object, in a ceiling panel of an embodiment of the present invention of which both end portions in a second direction are held on a ceiling base having a long shape extending in a first direction and being provided in parallel spaced in a second direction orthogonal to the first direction, the ceiling panel includes a panel body in a shape of a rectangular flat plate, a hooked portion provided for a first end portion of the panel body in the first direction, and a hooking portion to hook on a hooked portion of an adjacent ceiling panel to be provided in the first direction, the hooking portion being provided for a second end portion of the panel body in the first direction. The hooking portion has a folded part that is formed by being bent into a room side from a tip end portion in an extending direction of an extension portion extending outward in the first direction from a second end portion of the panel body in the first direction, and by being further folded inward in the first direction, and the hooked portion keeps hooking and holding of the folded part of the ceiling panel with a second end portion in the first direction of an adjacent ceiling panel to be provided in the first direction being positioned upward further than the first end portion in the first direction.

Effects of the Invention

The ceiling panel according to the embodiments of the present invention is constituted as mentioned above and the workability is improved.

BRIEF DESCRIPTION OF THE DRAWINGS

FIG. 1A is a schematic plan view, and FIG. 1B is a schematic side view.

DESCRIPTION OF THE EMBODIMENTS

The embodiments of the present invention are explained based on the drawings.

In some drawings, some detailed reference signs allotted in other drawings are omitted.

In the following embodiments, directions such as the vertical direction are explained under such a standard condition that a ceiling panel in the embodiment is constructed or to be constructed.

FIG. 1 to FIG. 6 diagrammatically illustrate one example of the ceiling panel and one example of construction procedures of the ceiling panel in the embodiment.

Figure 1A:
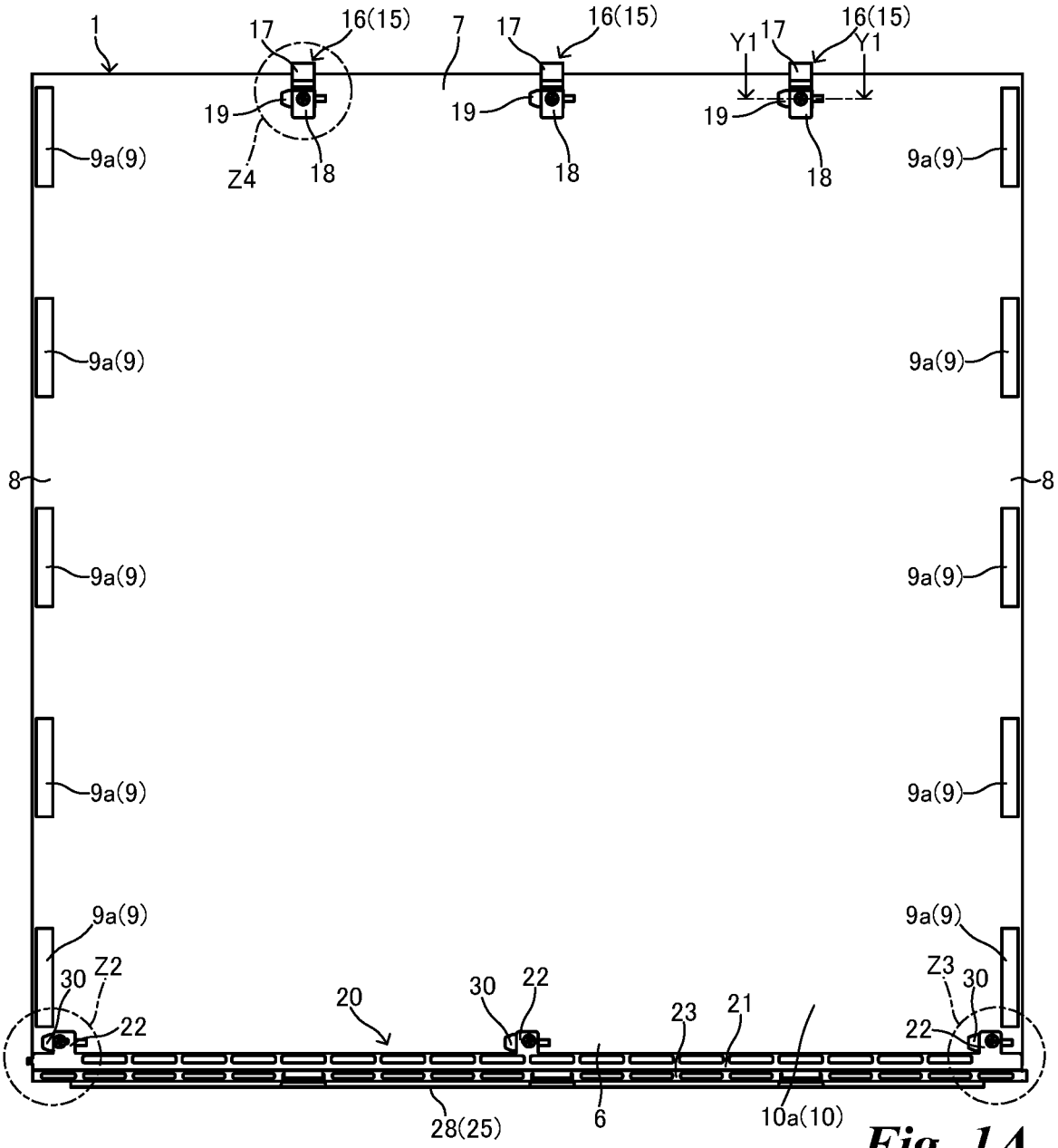
FIG. 1A and FIG. 1B diagrammatically illustrate an example of a ceiling panel according to one embodiment of the present invention.
Figure 1B:
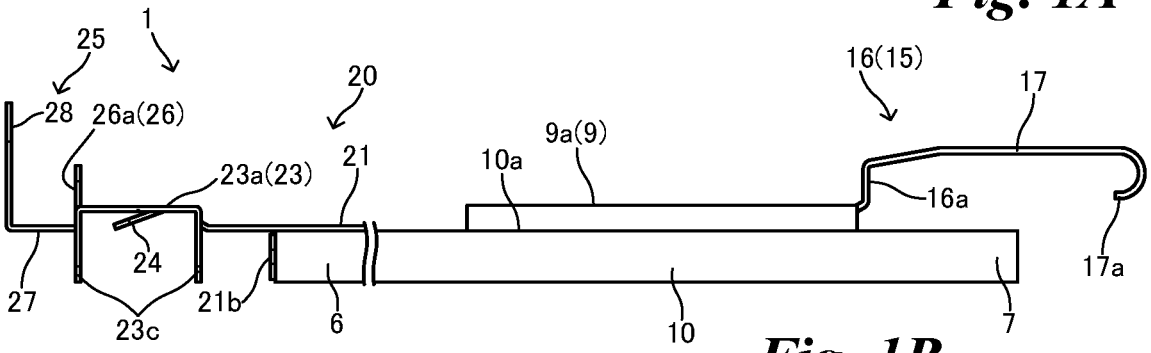
Figure 2A:
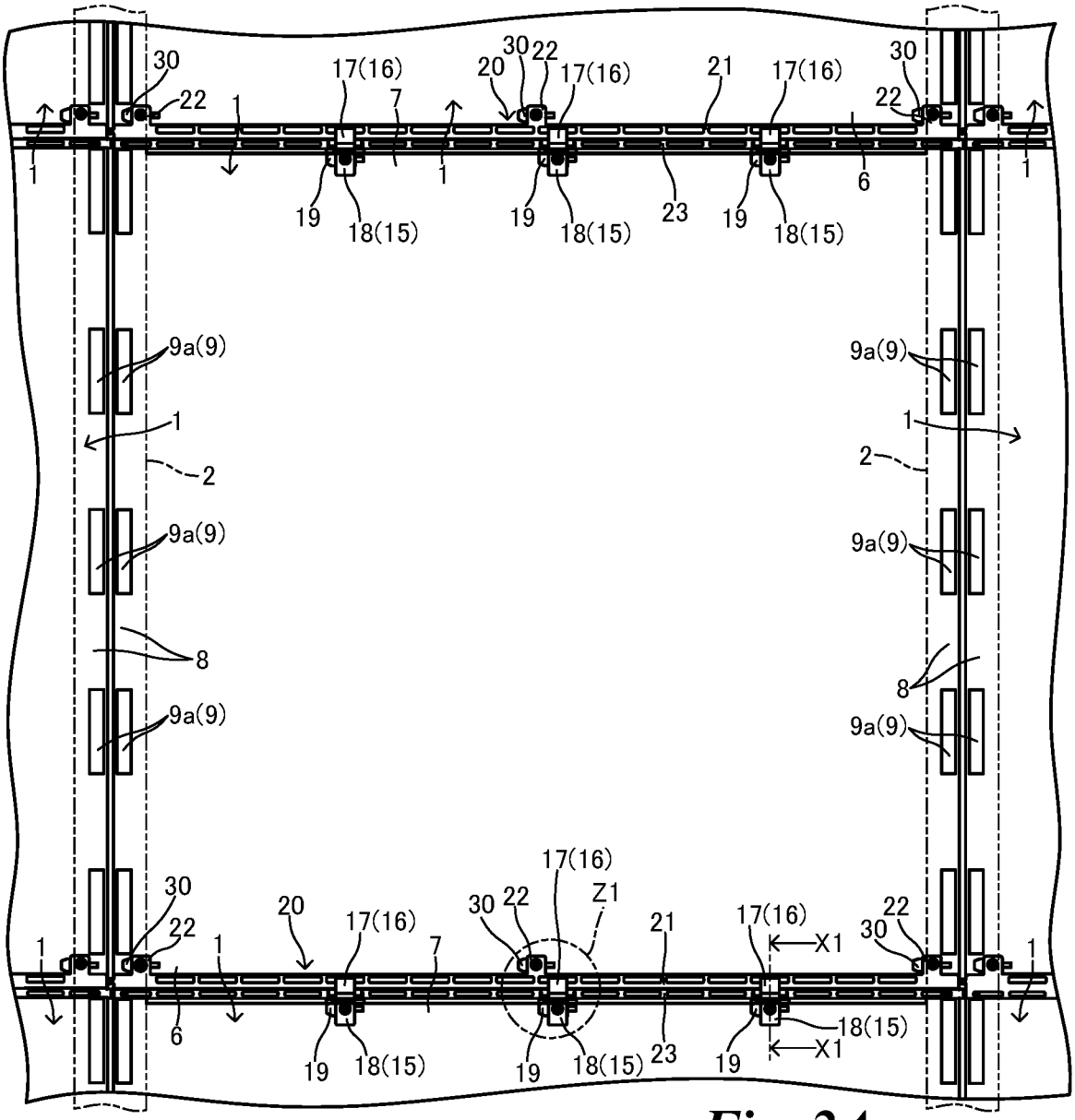
FIG. 2A is a partially broken schematic plan view diagrammatically illustrating that the ceiling panel is constructed.
Figure 2B:
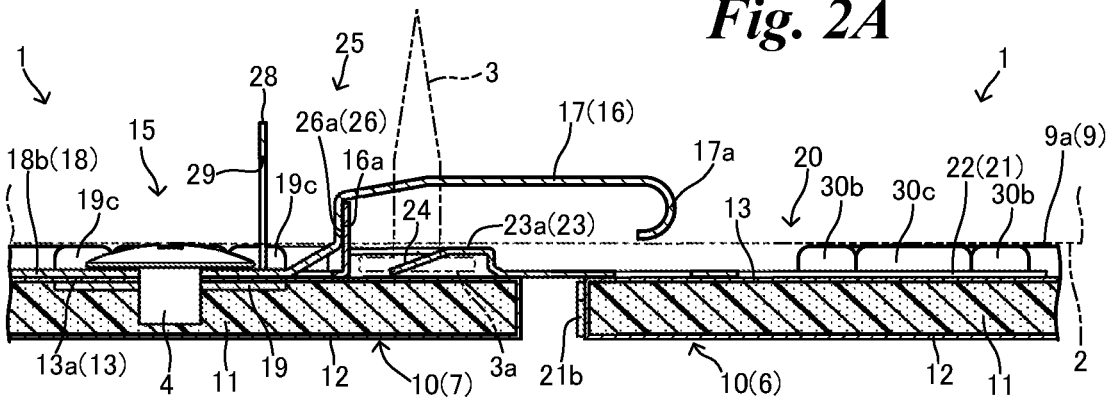
FIG. 2B is a partially broken schematic longitudinal sectional view along a line shown with arrows X-X in FIG. 2A.

A ceiling panel 1 in the embodiment has a panel body 10 in the shape of a rectangular flat plate as illustrated in FIG. 1A and FIG. 1B. The ceiling panel 1 is fixed to ceiling bases 2, 2 that have a long shape extending in the first direction and are arranged in parallel with a space in the second direction orthogonal to the first direction as illustrated in FIG. 2A and FIG. 2B. Held end portions 8, 8, i.e., end portions to be held, of the ceiling panel 1 at both end portions in the second direction are held to the ceiling bases 2, 2.

The ceiling base 2 to which the ceiling panel 1 is fixed can be a wood ceiling base, but it is a steel ceiling base made of ferromagnetic material in this embodiment. Such a ceiling base 2 can be made of a light steel material and can constitute a light ceiling base. The ceiling base 2 can be a ceiling joist constituting a suspended ceiling that is suspended by a suspension member such as a hanger or a hanging bolt through a ceiling joist receiver in the shape of a grooved steel, or in the shape of a channel, and can be constituted in several manners. A plurality of ceiling bases 2 are arranged in parallel with an approximately equal space, or at an approximately equal pitch, in the second direction orthogonal to the vertical direction and the first direction and constitute a ceiling base structure.

The ceiling panel 1 can be constructed as a ceiling of a relatively small-scale building such as a house or an office, or can be constructed as a ceiling in a relatively large-scale building such as a gymnasium, a hall, a shopping mall, a factory, or a school.

The ceiling panel 1 can be a panel of which mass per a unit area (1 $m^2$) is equal to or less than 2.0 kg. Or the mass of the ceiling panel 1 can be set in such a manner that the mass of the entire ceiling system including the ceiling base 2 constituted with the above-mentioned light ceiling base is equal to or less than 2.0 $kg/m^2$.

The panel body 10 is approximately rectangular on a plan view or seen in the thickness direction. The panel body 10 is approximately square on a plan view in this embodiment, but it can be approximately oblong. The size of the panel body 10 on a plan view can be suitably set in view of operability, workability and the like, and, for example, one side of the panel body 10 can be equal to or larger than 0.3 m in length or can be equal to or less than 2.0 m in length. In the approximately square panel body 10, one side can be equal to or larger than 0.4 m in length or equal to or less than 1.5 m in length, or can be from 0.9 m to 1.2 m in length. In the approximately oblong panel body 10, the short side can be equal to or larger than 0.3 m in length and the long side can be equal to or less than 2.0 m in length. The thickness of the panel body 10 can be, for example, 3.0 mm to 15.0 mm depending on a layer structure.

The panel body 10 can be a gypsum plaster board, a calcium silicate board, or the like. In this embodiment, the panel body 10 includes a base member 11 of resin foam system or of fibrous system as illustrated in FIG. 2B. An example of the base member 11 of resin form system is formed by a resin compound such as a polyurethane resin, a polystyrene resin, a polyethylene resin, a polypropylene resin, a phenolic resin, or an epoxy resin. An example of the base member 11 of fibrous system is formed by a mineral fiber such as a glass wool or a rock wool. In the figures, the base member 11 is a resin foam layer. The base member 11 can be greater part of the panel body 10, and the thickness of the base member 11 can be around 80% to 99% of the thickness of the panel body 10.

The panel body 10 has a surface layer 12 on one side, being on a room side, of the base member 11 in the thickness direction. The surface layer 12 can include a fire-retardant layer.

The above-mentioned fire-retardant layer can be suitably constituted in such a manner that the ceiling panel 1 satisfies the technical standard of performance required for a noncombustible material or the like stipulated by the Building Standard Law. For example, the ceiling panel 1 can be constituted so as to satisfy the standard of "fire-retardant material" in the technical standard, can preferably be constituted so as to satisfy the standard of "semi noncombustible material", or can more preferably be constituted so as to satisfy the standard of "noncombustible material". The fire-retardant layer can be an aluminum sheet in the shape of a thin sheet such as a foil-like sheet.

The surface layer 12 can be provided with a reinforcement layer including a reinforced fiber such as a glass fiber. The reinforcement layer can be a reinforced fiber sheet such as a glass cloth, or can be a fiber reinforced resin layer such as a glass fiber reinforced resin layer in which resin is impregnated into a reinforced fiber sheet. A downward or room-side face of the surface layer 12, i.e., a face on the inside of a room, can be a decorative surface provided with a suitable surface decorative treatment such as adhesion of a decorative sheet, printing, or painting, or can be a base face to be stuck with a suitable decorative sheet.

The panel body 10 is constituted by laminating a reinforcement layer 13 on the back face side, or on the side of the ceiling base, of the base member 11. Such a constitution achieves weight reduction by the base member 11 mentioned above and also restrains sagging by the reinforcement layer 13 on the back face side. The reinforcement layer 13 can be a reinforced fiber sheet such as a glass cloth, or can be a fiber reinforced resin layer such as a glass fiber reinforced resin layer in which resin is impregnated into a reinforced fiber sheet, as mentioned above.

The panel body 10 is constituted such that an end face layer is provided on side end faces of four peripheries of the base member 11. The end face layer can be constituted in the same manner as the surface layer 12. The end face layer can be successively formed from the surface layer 12 or can be separately formed in the shape of an edge sheet.

Magnets 9, 9 to be attracted to an attracted portion, i.e., a portion to be attracted, of the ceiling bases 2, 2 are provided on a back face 10*a* side of the held end portions 8, 8 provided for the panel body 10 on both sides in the second direction as illustrated in FIG. 1A. A hooked portion 25, i.e., a portion to be hooked, constituting a connected portion, i.e., a portion to be connected, is provided on the back face 10*a* side of a first end portion 6 of the panel body 10 in the first direction. A second end portion 7, one of end portions 6, 7 of the panel body 10 in the first direction, has a hooking portion 16 constituting a connection portion to hook on the hooked portion 25 of an adjacent ceiling panel 1 to be provided in the first direction. In such a constitution, the hooking portion 16 of the second end portion 7 is hooked on the hooked portion 25 of the adjacent ceiling panel 1 to be provided in the first direction, the magnets 9, 9 of the held end portions 8, 8 on both sides in the second direction are attracted to an attracted portion, i.e., a portion to be attached, of the ceiling bases 2, 2, and the ceiling panel 1 is attached or temporarily fixed. Thus, the ceiling panel 1 is easily constructed, the number of working people is reduced, and the construction is easily executed only by one person.

The magnet 9 is provided so as to extend in the first direction along the held end portion 8 as illustrated in FIG. 1A. The magnet 9 is provided in such a manner that the ceiling panel 1 is held or temporarily held by attraction to the ceiling bases 2, 2 on both sides in the second direction. In the embodiment, a plurality of magnets 9 (five in the figures) are provided for the held end portion 8 with a space in the first direction. The figures exemplify that a plurality of magnets 9 are provided at approximately equal intervals in the first direction. The magnets 9, 9 are also provided in the vicinity of the first end portion 6 and in the vicinity of the second end portion 7, respectively. In place of such a constitution, the magnet 9 can be provided along the held end portion 8 in the first direction almost entirely. The dimension in length of the magnet 9 along the first direction and the dimension in width of the magnet 9 along the second direction can be suitably set in view of retention performance or temporal retention performance, restraint of sagging, and weight reduction of the ceiling panel 1.

The magnet 9 is in the shape of a plate of which thickness direction is along the thickness direction of the panel body 10, referring also to FIG. 1B. The thickness dimension of the magnet 9 can be about 1 mm to 5 mm. In the embodiment, the magnet 9 is provided in a piled-up manner on the back face 10*a* of the panel body 10. The magnet 9 can be fixed to the panel body 10 with suitable glue, adhesive or the like. The attracted portion of the ceiling base 2 which is attracted by the magnetic force of the magnet 9 is the entire of the lower face, i.e., the face on the inside of a room, of the ceiling base 2 when the ceiling base 2 is made of a ferromagnetic material as mentioned above. In place of such a constitution, a suitable magnet in the shape of a sheet, a ferromagnetic material in the shape of a sheet, or the like can be provided as the attracted portion in an attached manner or in an embedded manner on the lower side of the ceiling base 2 made of a non-magnetic material.

The hooking portion 16 has a folded part 17*a* which is bent toward the inside of a room from a tip end portion in the extending direction of the extension portion 17 extending outward in the first direction from the second end portion 7 of the panel body 10 and which is further folded inward in the first direction as illustrated in FIG. 1A and FIG. 1B. The hooked portion 25 is constituted so as to be hooked and held by the folded part 17*a* of the ceiling panel 1 with the second end portion 7 of the adjacent ceiling panel 1 to be provided in the first direction being positioned upward further than the first end portion 6 as illustrated in FIG. 5 and FIG. 6. In such a constitution, the folded part 17*a* of an unconstructed ceiling panel 1 is hooked from below relative to the hooked portion 25 of the constructed ceiling panel 1 with the second end portion 7 side kept upward, and the ceiling panel 1 is held. Thus, compared with a constitution which requires to horizontally move the ceiling panel while keeping a horizontal condition at a high place, the workability is improved in the embodiment. In addition, the first end portion 6 side is raised so as to turn the ceiling panel 1 around the second end portion 7 side as a fulcrum after the condition such that the second end portion 7 side is held, thereby fixing to the ceiling base 2. In the embodiment, the magnets 9, 9 are provided for the held end portions 8, 8, as mentioned above, so that the ceiling panel 1 is easily held or temporarily held relative to the ceiling bases 2, 2 by the magnets 9, 9 of the held end portions 8, 8 when the first end portion 6 side is raised after the second end portion 7 side is held.

An abutting face 16*a* is provided on the base end side of the hooking portion 16 so as to face the folded part 17*a*, the abutting face 16*a* abutting on an abutted face 26*a*, i.e., a face to be abutted, provided for the hooked portion 25 of the adjacent ceiling panel 1 to be provided in the first direction. The abutting face 16*a* restricts movement of the ceiling panels 1, 1 adjacent to each other toward a close side in the first direction because the abutting face 16*a* abuts on the abutted face 26*a*. In such a constitution, when the unconstructed ceiling panel 1 is moved relative to the constructed ceiling panel 1 and the abutting face 16*a* abuts on the abutted face 26*a* while being held on the constructed ceiling panel 1 as mentioned above, the ceiling panels 1, 1 are easily positioned relative to each other. As illustrated in FIG. 2B, when a gap-like joint is provided between the end faces, facing in the first direction, of the ceiling panels 1, 1 adjacent to each other in the first direction, the gap between the ceiling panels 1, 1 is easily made equal. The gap between the ceiling panels 1, 1 adjacent to each other in the first direction can be about 1 mm to 15 mm.

Figure 4A:
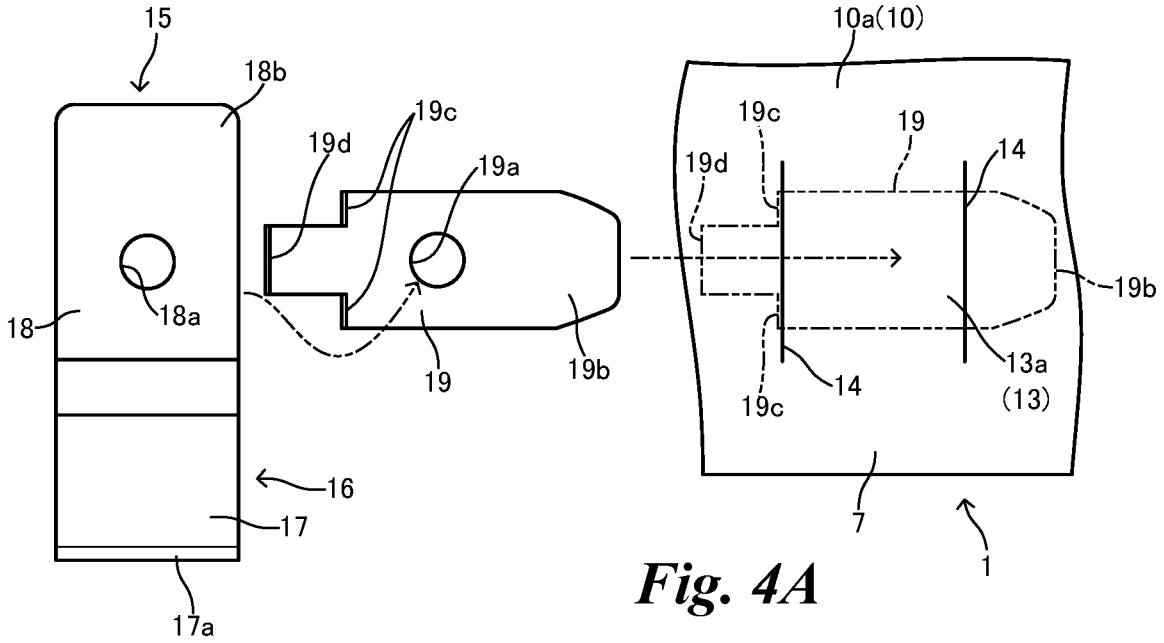
FIG. 4A is a partially broken schematic exploded plan view corresponding to Z4 in FIG. 1A.
Figure 4B:
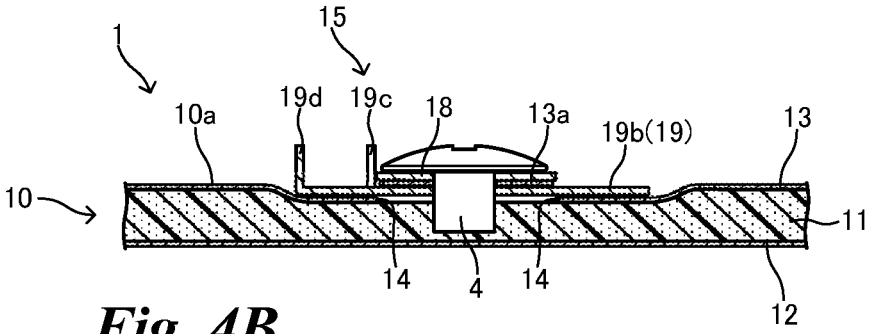
FIG. 4B is a partially broken schematic longitudinal sectional view along a line shown with arrows Y-Y in FIG. 1A, and FIG. 4C diagrammatically illustrates a variation of a connection member provided for the ceiling panel and is a partially broken diagrammatic longitudinal sectional view corresponding to FIG. 4B.

The hooking portion 16 is provided for a connection member 15 having a base end side part 18 disposed so as to be along the back face 10*a* of the second end portion 7. In such a constitution, the connection member 15 is inconspicuous from the front side. As illustrated in FIG. 4A and FIG. 4B, the connection member 15 is fixed to the second end portion 7 by the securing tool 4 that is fixed to an insertion part 19 inserted into the layer of the panel body 10 from a cut portion 14 so as to penetrate a base end side part 18, the cut portion 14 opening on the back face 10*a* of the second end portion 7 and extending in the first direction. In such a constitution, the connection member 15 is mechanically fixed to the second end portion 7 by the fastener 4 fastened to the insertion portion 19 with a back face side layer, or a clamped layer 13*a*, i.e., a layer to be clamped, of the panel body 10 held between the insertion part 19 and the base end side part 18. Compared with a constitution in which the base end side part 18 is fixed to the second end portion 7 by an adhesive or the fastener 4 fastened only to the panel body 10, the securing strength of the connection member 15 to the second end portion 7 is improved under the constitution in which the connection member 15 is provided on the back face side. In addition, the load applied to the back face side layer around the cut portion 14 is reduced when the load along the direction of the panel thickness is applied to the hooking portion 16 by the own weight of the ceiling panel 1 or the weight of the adjacent ceiling panel 1 to be provided, compared with a constitution in which the insertion part 19 is inserted into the cut portion extending in the second direction.

In the embodiment, the cut portion 14 is constituted so as to penetrate the reinforcement layer 13 on the back face 10*a* side of the panel body 10. In such a constitution, the insertion part 19 is arranged so as to be embedded into an inner layer side further than the reinforcement layer 13. The clamped layer 13*a* including at least the reinforcement layer 13 is held between the insertion part 19 and the base end side part 18, thereby effectively improving the securing strength of the connection member 15 to the second end portion 7. The securing strength of the connection member 15 is improved compared with such a constitution that only a resin foam layer or a mineral fiber layer constitutes the clamped layer without providing the reinforcement layer 13.

In the embodiment, the cut portions 14, 14 are provided at two positions in parallel with a space in the second direction. The insertion part 19 is inserted into one of the cut portions 14, 14, a tip end portion 19*b* in the insertion direction is exposed on the back face 10*a* side of the panel body 10 through the other cut portion 14. In such a constitution, the weight applied when the above-mentioned load is applied to the hooking portion 16 is dispersed into the back face side layer around two cut portions 14, 14 to be loaded, compared with such a constitution that the insertion part 19 is inserted into one cut portion 14. Therefore, the securing strength of the connection member 15 to the second end portion 7 is effectively improved.

In the embodiment, the base end side part 18 has an extension portion 18*b* extending inward in the first direction, or on the side of the first end portion 6, further than the insertion part 19. In such a constitution, the weight which makes the hooking portion 16 turn into the ceiling base 2 side relative to the panel body 10 by being applied with the above-mentioned load is received by the extension portion 18*b* provided along the back face 10*a* of the panel body 10. Thus, the securing strength of the connection member 15 to the second end portion 7 is effectively improved.

In the embodiment, the insertion part 19 is separately provided from the base end side part 18. In such a constitution, the clamped layer 13*a* is restrained from being hooked or twisted when the insertion part 19 is inserted, compared with such a constitution that the insertion part 19 is integrally provided with the base end side part 18.

The base end side part 18 is in the shape of a plate of which thickness direction is along the thickness direction of the panel body 10. The figures exemplify that the base end side part 18 is roughly in the shape of a rectangle seen in the thickness direction. In the exemplification, both corner portions of the inside end portions in the first direction of the base end side part 18, i.e., the extension portion 18*b* in the embodiment, are in the shape of a protruding curve seen in the thickness direction.

The base end side part 18 is provided with an insertion through hole 18*a* into which a shaft portion of the fastener 4 is inserted.

The dimension of the base end side part 18 along the first direction is larger than that of the insertion part 19 along the first direction so as to form the extension portion 18*b* inside in the first direction. The extension portion 18*b* is successively provided from the inside region of the base end side part 18 in the first direction. The thickness dimension of the base end side part 18 can be suitably set in view of strength, weight reduction, or the like, and, for example, can be about 0.3 mm to 3 mm.

The hooking portion 16 is successively provided for the outer end portion of the base end side part 18 in the first direction. The base end portion of the hooking portion 16 has a raised part provided so as to rise upward, or toward the side of the ceiling base 2, from the outer end portion of the base end side part 18 in the first direction, and a face of the raised part on the outside in the first direction constitutes the abutting face 16*a* as illustrated in FIG. 1B and FIG. 2B. In the figures, the raised part is provided through an inclined part extending obliquely upward from the outer end portion of the base end side part 18 in the first direction.

The extension portion 17 is provided so as to extend outward in the first direction from the upper end portion of the raised part. The protruding dimension of the extension portion 17 along the first direction from the end face of the second end portion 7 of the panel body 10 can be suitably set so as to easily hook on the hooked portion 25 of the constructed ceiling panel 1 from below or in view of achieving weight reduction.

The extension portion 17 is in the shape of a hook and has the folded part 17*a* on the tip end portion. The tip end of the folded part 17*a* is provided so as to be directed inward in the first direction. The figures exemplify that the tip end of the folded part 17*a* is positioned at the same height as the raised part constituting the abutting face 16*a*. In the figures, the folded part 17*a* is approximately in the shape of a half circular arc, or in the shape like a letter C, seen in the second direction; however, the folded part 17*a* can be approximately in the shape of a letter V having a single flexed portion or can have a plurality of flexed portions. The dimension of the folded regions of the folded part 17*a* along the first direction can be suitably set so as to easily hook on the hooked portion 25 of the constructed ceiling panel 1 from below or in view of achieving weight reduction.

The inclined part, the raised part, the extension portion 17, and the folded part 17*a* of the hooking portion 16 can be the same as the base end side part 18 in thickness and can be suitably formed successively by a press working or a bending procedure. The width dimension of the hooking portion 16 along the second direction is the same as the width dimension of the base end side part 18 along the second direction.

The insertion part 19 is roughly in the shape of a plate of which thickness direction is along the thickness direction of the panel body 10 as illustrated in FIG. 4A and FIG. 4B. The figures exemplify that the insertion part 19 is roughly in the shape of a rectangle seen in the thickness direction. The tip end portion 19*b* in the insertion direction of the insertion part 19 is gradually tapered toward the tip end side seen in the thickness direction. In such a constitution, the insertion part 19 is easily inserted into the layer of the panel body 10 through the cut portion 14. Both corner portions of the tip end portion 19*b* in the insertion direction are in the shape of a protruding curve seen in the thickness direction.

The insertion part 19 is provided with a fastening hole 19*a* to which the shaft portion of the fastener 4 is fastened. The fastening hole 19*a* can be a female hole with which the shaft portion of the fastener 4 is screwed or can be a base hole into which the shaft portion of the fastener 4 is screwed. The thickness dimension of the insertion part 19 can be suitably set in view of strength, weight reduction, or the like, and, for example, can be 0.5 mm to 3 mm.

In the embodiment, the base end portion in the insertion direction of the insertion part 19 has raised parts 19*c*, 19*d* rising upward, or toward the side of the ceiling base 2. In the figures, the raised parts 19*c*, 19*c* which are abutted on one side portion of the base end side part 18 are separated on both ends in the first direction, and the raised part 19*d* rising from the extension portion extending in the reverse insertion direction is provided between the raised parts 19*c*, 19*c*. In such a constitution, the insertion part 19 is easily inserted into the layer of the panel body 10 through the cut portion 14 with the raised part 19*d* being grasped. The raised parts 19*c*, 19*c* on both sides are constituted such that the dimension along the insertion direction from the raised parts 19*c*, 19*c* to the center of the fastening hole 19*a* is approximately the same as the dimension along the same direction from one side portion of the base end side part 18 along the same direction to the center of the insertion through hole 18*a*. In such a constitution, when one side portion of the base end side part 18 is abutted on the raised parts 19*c*, 19*c* and the base end side part 18 is piled on the insertion part 19, the centers of the fastening hole 19*a* and the insertion through hole 18*a* coincide in the second direction, thereby achieving easy positioning.

The raised parts 19*c*, 19*c*, 19*d* are successively provided at the base end portion in the insertion direction of the insertion part 19. The rising dimension of the raised parts

19*c*, 19*c*, 19*d* along the thickness direction of the panel can be suitably set so as not to interfere with the base which is sometimes provided in the middle region of the ceiling panel 1 in the second direction for attaching facility equipment or the like and for reinforcement. The figures exemplify that the tip end portions of the raised parts 19*c*, 19*c*, 19*d* in the rising direction are approximately the same in height as an abutting face 9*a* to be abutted on the magnet 9 of the ceiling base 2.

The dimension of the insertion part 19 from the raised part 19*c* along the insertion direction, or the second direction, is larger than the dimension of the base end side part 18 along the second direction in such a manner that the tip end portion 19*b* in the insertion direction is exposed on the back face 10*a* side of the panel body 10. The dimension along the second direction between two cut portions 14, 14 provided for the panel body 10 is smaller than the dimension of the insertion part 19 along the second direction. The dimension of the cut portions 14, 14 along the first direction is larger than the dimension of the insertion part 19 along the first direction. The dimension of the cut portions 14, 14 along the first direction can be slightly larger than the dimension of the insertion part 19 along the first direction.

The insertion part 19 can be successively produced by a suitable press working, a bending procedure or the like. The hooking portion 16 including the insertion part 19 and the base end side part 18 can be made of a suitable metal material.

The connection member 15 constituted as mentioned above can be fixed to the second end portion 7 of the panel body 10 to be mentioned below.

The insertion part 19 is inserted into the layer of the panel body 10 through one of the cut portions 14, 14 formed at the second end portion 7 of the panel body 10. The cut portions 14, 14 can be formed using a suitable cutter or the like so as to penetrate at least the reinforcement layer 13. The tip end portion 19*b* in the insertion direction of the insertion part 19 is exposed on the back face 10*a* side of the panel body 10 through the other cut portion 14, and the insertion part 19 is attached to the second end portion 7 of the panel body 10. In such a case, the insertion part 19 can be attached such that the base member 11 of the panel body 10 is deformed by compression, referring to FIG. 4B. In such a condition, the clamped layer 13*a* including the reinforcement layer 13 between the cut portions 14, 14 is provided on the upper side of the insertion part 19. The clamped layer 13*a* can include a part of the base member 11.

The base end side part 18 is piled on the clamped layer 13*a* so as to coincide the insertion through hole 18*a* with the fastening hole 19*a* of the insertion part 19, and the position of the insertion part 19 and the base end side part 18 is adjusted in such a manner that the protruding dimension of the hooking portion 16 outward in the first direction becomes a predetermined dimension. Then, the fastener 4 is fastened to the fastening hole 19*a* of the insertion part 19 through the insertion through hole 18*a* of the base end side part 18. Thus, the shaft portion of the fastener 4 penetrates the clamped layer 13*a* held between the base end side part 18 and the insertion part 19, and the insertion part 19 and the base end side part 18 are fixed to the second end portion 7. The figures exemplify that the shaft portion of the fastener 4 is provided so as to exceed the center of the base member 11 in the thickness direction; however, the embodiment is not limited to such an exemplification. The insertion part 19 is not limited to the exemplification mentioned above, and one or both of the raised parts 19*c*, 19*c*, 19*d* and the tip end portion 19*b* in the insertion direction which is exposed on the back face 10*a* are not always required. The base end side part 18 is not limited to the exemplification mentioned above, and the extension portion 18*b* as mentioned above is not always required.

In the embodiment, as illustrated in FIG. 1A, a plurality of connection members 15, 15, 15 (three in the figures) are provided for the second end portion 7 spaced in the second direction. The connection members 15, 15, 15 are similarly constituted. The connection members 15, 15, 15 are respectively spaced at approximately equal intervals. The figures exemplify that the dimension along the second direction from each end face of the held end portions 8, 8 on both sides in the second direction to the connection members 15, 15 on the outermost side in the second direction is almost the same as the dimension between the connection members 15, 15 adjacent to each other. The connection members 15, 15, 15 are not always required to be provided for the second end portion 7 close to the wall of the ceiling panel 1 provided close to the wall.

Figure 4C:
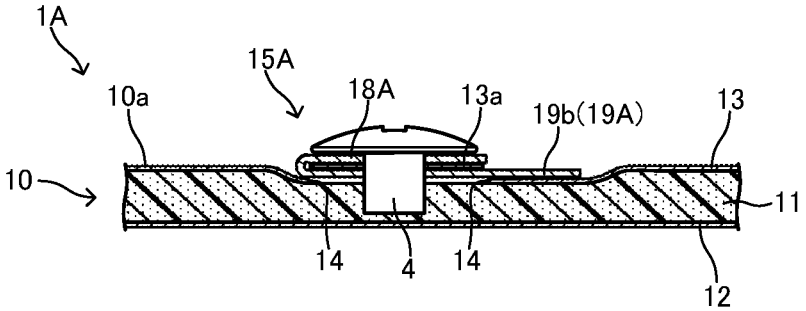

In place of the connection member 15 as mentioned above, the connection member 15 can be a connection member 15A provided for a ceiling panel 1A of a variation illustrated in FIG. 4C. In the following variation, the difference with the above-mentioned embodiment is mainly explained, the similar members have the same reference numerals, and explanation of such reference numerals is omitted or simplified. The effects and the attachment procedures which are the same as those of the above-mentioned embodiment are not explained or are simply explained.

The connection member 15A in the variation is constituted such that an insertion part 19A is bent from one side portion of a base end side part 18A in the second direction and is integrally provided with the connection member 15A. Such a constitution improves operability compared with the above-mentioned constitution in which the insertion part 19 is separately provided from the connection member 15, i.e., the base end side part 18. When the fastening hole 19*a* and the insertion through hole 18*a* are provided for the insertion part 19A and the base end side part 18A, positioning thereof is not required, thereby improving attachment performance.

The insertion part 19A is successively provided for one side portion of the base end side part 18A in the second direction. The dimension of the gap between the base end side part 18A and the insertion part 19A along the thickness direction is suitably set so as to facilitate reception of the clamed layer 13*a*. A suitable inclined guide face or the like can be provided for the other end of the base end side part 18A in the second direction so as to facilitate reception of the held layer 13*a*.

The first end portion 6 side of the ceiling panel 1 provided with the above-mentioned connection member 15 and the construction procedures are explained as below and are the same as the first end portion 6 side of the ceiling panel 1A provided with the connection member 15A and the construction procedures in the variation.

The connection members 15, 15A are not limited to be fixed to the second end portion 7 through the insertion parts 19, 19A as mentioned above. Like a reinforcement member 20 to be mentioned later, the connection members 15, 15A can be provided along the first direction of the second end portion 7 almost entirely. Namely, the hooking portion 16 can be provided for the reinforcement member provided along the first direction of the second end portion 7 almost entirely. The connection members 15, 15A and the hooking portion 16 provided for the second end portion 7 of the panel body 10 can be variously modified.

A securing part 23 which protrudes outward in the first direction from the first end portion 6 and is fixed to the ceiling base 2 is provided on the back face 10*a* side of the first end portion 6 of the panel body 10 as illustrated in FIG. 2B. In such a constitution, the fastener 3 is fastened toward the ceiling base 2 from inside of the room, or from below, through the securing part 23 protruding outward in the first direction from the first end portion 6, and the ceiling panel 1 is fixed to the ceiling base 2, referring to FIG. 5B. The hooking portion 16 of the second end portion 7 of the adjacent ceiling panel 1 to be provided in the first direction hooks on the hooked portion 25 of the first end portion 6 of the ceiling panel 1 fixed to the ceiling base 2 through the securing part 23. The securing part 23 is constituted to protrude outward in the first direction from the back face 10*a* side of the panel body 10, so that the securing part 23 is inconspicuous from the surface side because of the ceiling panel 1 when the adjacent ceiling panel 1 to be provided in the first direction is connected.

In the embodiment, an abutting face 23*a*, abutting on the ceiling base 2, of the securing part 23 and an abutting face 9*a*, abutting on the ceiling base 2, of the magnet 9 are on the same plane. In such a constitution, the abutting faces 9*a*, 23*a* are stably abutted on the ceiling base 2 while reducing such a requirement that the magnet 9 is provided in an embedded manner. The constitution such that the abutting face 23*a* of the securing part 23 and the abutting face 9*a* of the magnet 9 are on the same plane is not limited to a constitution in which they are completely on the same plane, and includes such a constitution that there is a difference of about 2 mm in the thickness direction of the panel.

The securing part 23 is provided so as to have a gap between the securing part 23 and the back face 10*a* of the ceiling panel 1 which is provided downward the securing part 23 and is adjacent in the first direction, the gap having the dimension larger than the dimension of a head portion 3*a* of the fastener 3 along the axial direction, the fastener 3 fixing the securing part 23 to the ceiling base 2. Such a constitution restrains the interference of the back face 10*a* of the adjacent ceiling panel 1 to be provided in the first direction and the head portion 3*a* of the fastener 3 fixing the securing part 23 to the ceiling base 2 and restrains occurrence of the level difference between the surfaces of the ceiling panels 1, 1 adjacent to each other in the first direction.

In the embodiment, as illustrated in FIG. 1, the securing part 23 and the hooked portion 25 are provided for the reinforcement member 20 fixed almost entirely along the second direction so as to be along the back face 10*a* of the first end portion 6 of the panel body 10. In such a constitution, in the same manner as mentioned above, the reinforcement member 20 is inconspicuous from the surface side, and the strength of the first end portion 6 of the ceiling panel 1 is improved by the reinforcement member 20, thereby restraining sagging and the like. In addition, the securing part 23 is stably fixed to the ceiling base 2, and the retaining strength of the second end portion 7 of the adjacent ceiling panel 1 to be provided in the first direction is improved, the second end portion 7 hooking on the hooked portion 25 of the reinforcement member 20 fixed as mentioned above. The constitution reduces such a requirement that the ceiling base is provided in the second direction at a relatively small pitch and restrains sagging of the center region of the ceiling panel 1 in the second direction under such a constitution that a joiner and the like are not exposed on the surface side. Namely, while reducing the weight of the entire ceiling system including the ceiling base 2, the retaining strength of the ceiling panel 1 is improved and the appearance on the surface side is improved by inhibiting sagging.

The reinforcement member 20 is long in the second direction of the panel body 10, and has a base portion 21 disposed along the back face 10*a* of the first end portion 6 and an attachment portion 22 provided for the base portion 21 to attach the reinforcement member 20 to the panel body 10.

The base portion 21 is provided along the panel body 10 in the second direction almost entirely and is in the shape of a plate of which thickness direction is along the thickness direction of the panel body 10. In the embodiment, the base portion 21 is provided entirely along the second direction of the panel body 10. The reinforcement member 20 to be provided in the second direction of the panel body 10 almost entirely can be equal to or more than seven-tenths of the panel body 10 along the second direction in length.

The width along the first direction and the thickness of the base portion 21 can be suitably set in view of strength and weight reduction. The figures exemplify that the base portion 21 is provided with a plurality of long holes of which diameters are long in the second direction, the long holes being spaced in the second direction. A region protruding from the end face of the first end portion 6 outward in the first direction further than the region where the long holes of the base portion 21 are provided is arranged to define the bottom side of the gap formed between the ceiling panels 1, 1 adjacent to each other in the first direction.

Figure 3A:
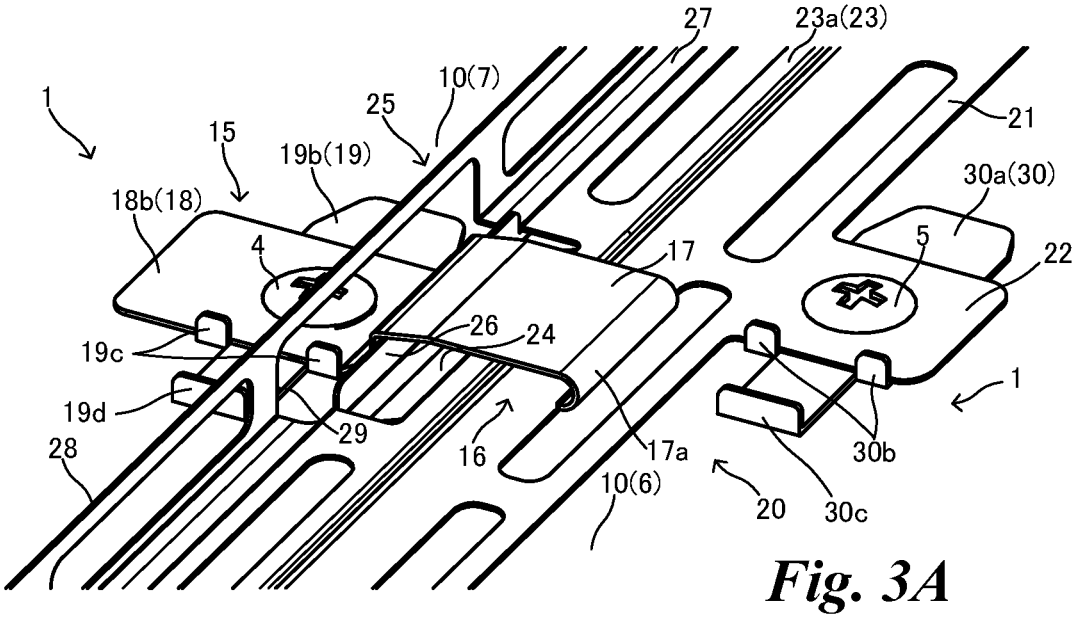
FIG. 3A is a partially broken schematic perspective view corresponding to Z1 in FIG. 2A.
Figure 3B:
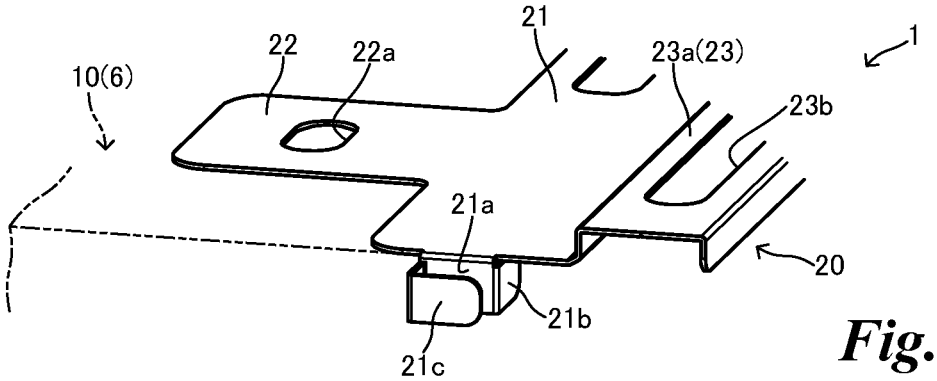
FIG. 3B is a partially broken schematic perspective view corresponding to Z2 in FIG. 1A.

In the embodiment, as illustrated in FIG. 3B, the base member 21 has a first abutting part 21*a* abutting on the end face of one held end portion 8 of the panel body 10 and a second abutting part 21*b* abutting on the end face of the first end portion 6. Such a constitution facilitates position adjustment of the attachment position of the reinforcement member 20 to the panel body 10.

The first abutting part 21*a* and the second abutting part 21*b* are provided so as to protrude downward from the first end portion of the base member 21 in the longitudinal direction. The figures exemplify that the first abutting part 21*a* and the second abutting part 21*b* are provided successively and in orthogonal with each other so as to be disposed along the external corner of the end face of one held end portion 8 and the end face of the first end portion 6. One of or both of the first abutting part 21*a* and the second abutting part 21*b* can also be provided for the second end portion of the base member 21 in the longitudinal direction.

In the embodiment, the first end portion of the base member 21 in the longitudinal direction has a third abutting part 21*c* abutting on the end face of the held end portion 8 of the panel body 10 of the adjacent ceiling panel 1 to be provided in the second direction. The third abutting part 21*c* is provided so as to protrude from the end face of the held end portion 8 of the panel body 10 so as to form the gap-like joint as mentioned above between the end faces, facing each other in the second direction, of the ceiling panels 1, 1 adjacent to each other in the second direction. Such a constitution easily makes the gap between the ceiling panels 1, 1 equal. The figures exemplify that the third abutting part 21*c* is successively provided for the first abutting part 21*a* through a protruding part protruding outward in the second direction from the first abutting part 21*a*. The lower face of the ceiling base 2 is arranged on the bottom side of the gap formed between the ceiling panels 1, 1 adjacent to each other in the second direction and defines the bottom side of the gap.

The attachment portion 22 is successively provided so as to extend inward in the first direction from the inner side portion of the base portion 21 in the first direction and is in the shape of a piece of which thickness is the same as that of the base portion 21. In the embodiment, a plurality of attachment portions 22, 22, 22 (three in the figures) are provided so as to be spaced in the longitudinal direction of the base portion 21. The attachment portions 22, 22 are provided in the vicinity of the held end portions 8, 8 on both sides of the panel body 10 in the second direction, respectively. Another attachment portion 22 is provided at almost equal intervals between the attachment portions 22, 22 on both sides in the second direction.

Figure 3C:
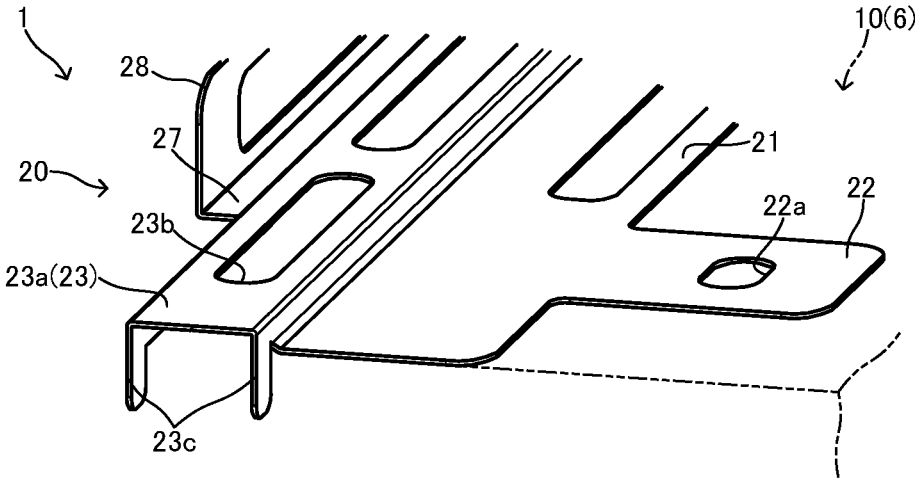
FIG. 3C is a partially broken schematic perspective view corresponding to Z3 in FIG. 1A.

As illustrated in FIG. 3B and FIG. 3C, the attachment portions 22, 22, 22 are provided with an insertion through hole 22*a* to be inserted by the shaft portion of a fastener 5, referring to FIG. 3A, to be fixed to the panel body 10. As illustrated in FIG. 3A, an insertion part 30 like the one mentioned above is provided for the attachment portions 22, 22, 22 on the inner layer side of the panel body 10. The insertion part 30 is provided with a fastening hole like the one mentioned above, which is omitted in the figures. The insertion part 30 has a tip end portion 30*a* in the insertion direction and raised parts 30*b*, 30*b*, 30*c* like the above-mentioned embodiment. The embodiment of fixing the reinforcement member 20 to the panel body 10 is not limited to such a constitution and various variations are possible.

The securing part 23 is provided for the panel body 10 along the second direction almost entirely and is in the shape of a plate of which thickness direction is along that of the panel body 10 as illustrated in FIG. 1. The securing part 23 is provided for the base portion 21 successively through a raised part provided so as to rise upward from the outer end portion of the base portion 21 in the first direction. The rising dimension of the raised part is suitably set in such a manner that the abutting face 23*a* on the upward side of the securing part 23 is on the same plane as the abutting face 9*a* of the magnet 9 as mentioned above. The rising dimension of the raised part is suitably set in such a manner that the dimension along the thickness direction of the panel from the downward face of the securing part 23 to the back face 10*a* of the panel body 10 is equal to or larger than the dimension of the head portion 3*a* of the fastener 3 along the axial direction.

The width dimension along the first direction and the thickness dimension of the securing part 23 can be suitably set in view of strength and weight reduction. The figures exemplify that the securing part 23 is provided with a plurality of long holes of which diameters are long in the second direction at intervals in the second direction like the base portion 21. As illustrated in FIG. 3B and FIG. 3C, insertion through holes 23*b*, 23*b* to be inserted by the shaft portion of the fastener 3 to be fastened to the ceiling bases 2, 2 are provided for both end portions of the securing part 23 in the longitudinal direction. The insertion through holes 23*b*, 23*b* are long holes of which diameters are long in the second direction.

In the embodiment, an abutting part 23*c* is provided for the second end portion of the securing part 23 in the longitudinal direction as illustrated in FIG. 3C, the abutting part 23*c* abutting on the end face of the held end portion 8 of the ceiling panel 1 and facing in the second direction of the second end portion of the securing part 23 in the longitudinal direction. Such a constitution easily makes the gap between the ceiling panels 1, 1 equal. The figures exemplify that the second end portion in the longitudinal direction of the securing part 23 protrudes outward in the second direction and the abutting parts 23*c*, 23*c* are provided in a pair so as to hang downward from both end portions of the protruding portion in the first direction.

Figure 6A:
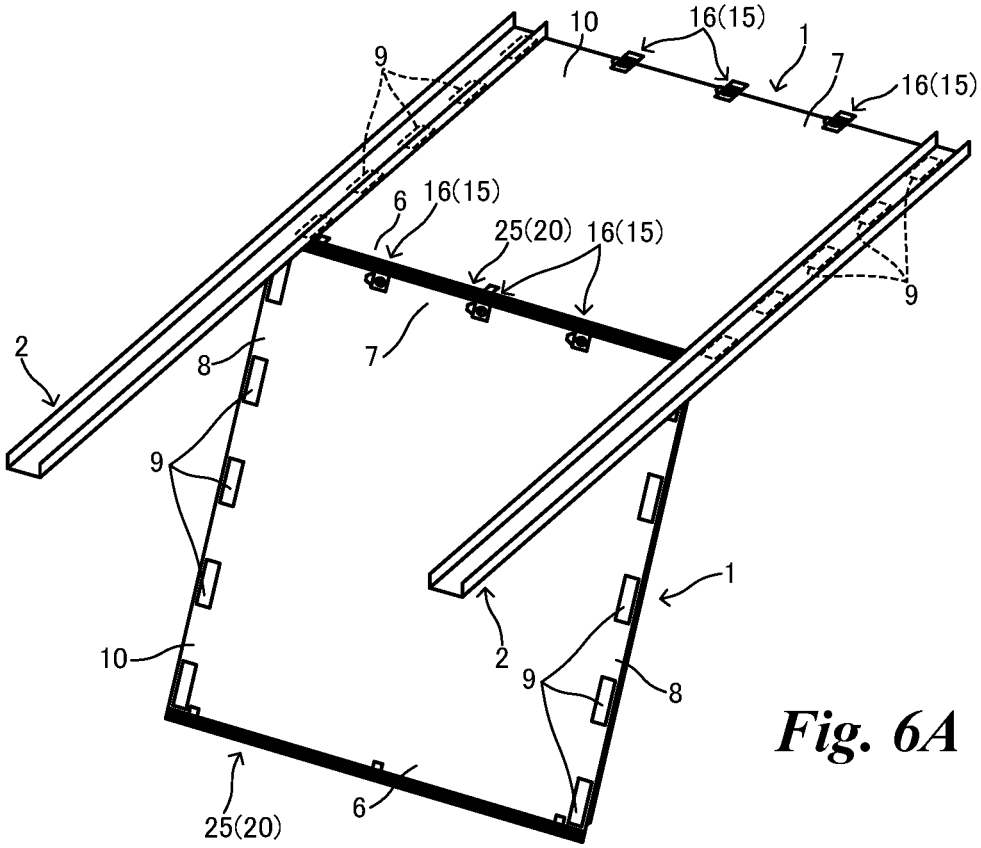
FIG. 6A is a schematic perspective view diagrammatically illustrating one example of a construction procedure of the ceiling panel, and FIG. 6B diagrammatically illustrates one example of the construction procedure and is a partially broken schematic longitudinal sectional view corresponding to FIG. 2B.
Figure 6B:
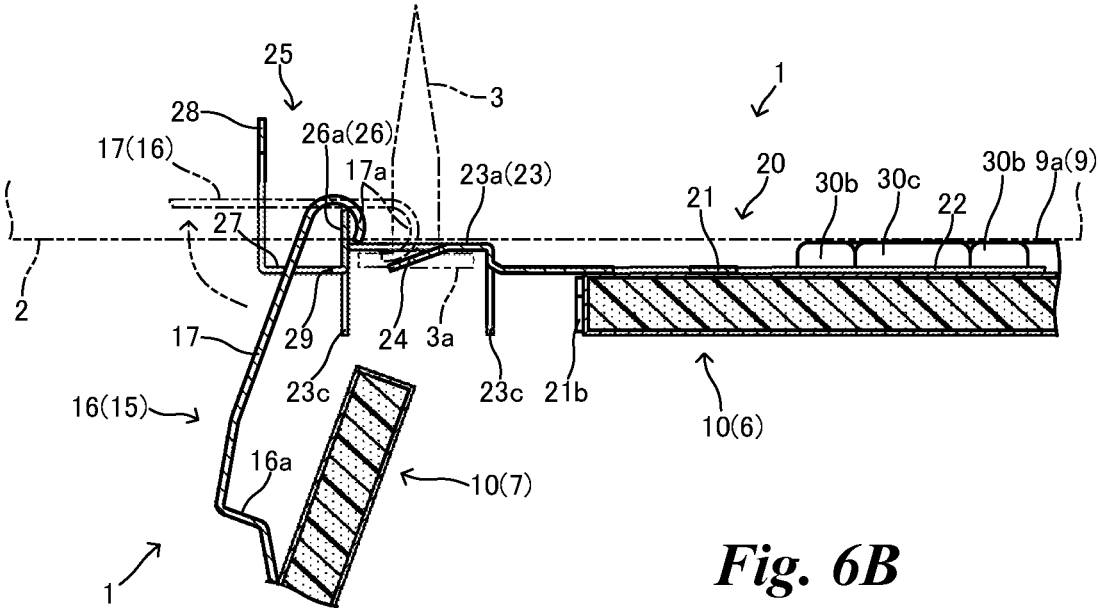

As illustrated in FIG. 1B and FIG. 6B, the hooked portion 25 is provided on the outside of the securing part 23 in the first direction.

In the embodiment, the hooked portion 25 is in the shape of a plate of which thickness direction is along the first direction and has a hooked part 26 on which the folded part 17*a* of the hooking portion 16 is hooked. The hooked portion 25 is positioned outside in the first direction further than the hooked part 26, is also provided in parallel with the hooked part 26, and has a drop-out prevention part 28 provided with an insertion through hole 29 to be inserted by the folded part 17*a*. In such a constitution, the folded part 17*a* comes to be inserted into the insertion through hole 29 of the drop-out prevention part 28 while being hooked and held on the hooked part 26. Thus, when impact is applied from below to the unconstructed ceiling panel 1 with the folded part 17*a* being held on the hooked portion 25 of the constructed ceiling panel 1 as mentioned above, a hooked and held condition is hardly released and unintentional drop-out of the unconstructed ceiling panel 1 is restrained.

The hooked part 26 is provided so as to protrude upward from the outer end portion of the securing part 23 in the first direction. The face of the hooked part 26 on the outside in the first direction constitutes the abutted face 26*a* to be abutted on the abutting face 16*a* of the hooking portion 16.

The dimension of the hooked part 26 along the second direction is larger than that of the hooking portion 16 along the second direction. The protruding dimension of the hooked part 26 is suitably set so as to keep the folded part 17*a* of the hooking portion 16 hooked. In the embodiment, the hooked part 26 is provided so as to be cut in and raised from the securing part 23 as illustrated in FIG. 3A. The hooked part 26 is provided at a plurality of positions (three in the figures) spaced in the second direction along the first end portion 6 of the panel body 10 so as to be positioned corresponding to the hooking portion 16.

In the embodiment, as illustrated in FIG. 6B, the securing part 23 has an inclined guide part 24 constituting a guide of the folded part 17*a*. When the ceiling panel 1 held by the hooked part 26 is moved to a close side in the first direction relative to the ceiling panel 1 provided with the inclined guide part 24, the inclined guide part 24 functions as a guide of the folded part 17*a* which moves in the same direction. The inclined guide part 24 is provided so as to be cut in and raised downward, which is opposite side to the hooked part 26, from the middle region of the securing part 23 in the first direction. The inclined guide part 24 is gradually inclined in the shape of a downward slope outward in the first direction. In such a constitution, when the hooked part 26 is provided in a cut-in and raised manner, the folded part 17*a* is hardly hooked on the edge of the hole of the securing part 23, and the folded part 17*a* is smoothly guided inward in the first direction along the inclined guide part 24. The inclined guide part 24 is positioned corresponding to the hooked part 26. Namely, the inclined guide part 24 is provided at a plurality of positions (three in the figures) spaced in the second direction along the first end portion 6 of the panel body 10.

The drop-out prevention part 28 is provided so as to rise upward from the tip end portion of an extension part 27 extending outward in the first direction from the lower end portion of a hang-down part hanging downward from the outer end portion of the securing part 23 in the first direction. The hang-down part, the extension part 27, and the drop-out prevention part 28 are provided along the panel body 10 in the second direction almost entirely. Such a constitution improves stiffness of the reinforcement member 20 while achieving reduction of thickness and weight of the reinforcement member 20. The figures exemplify that the hang-down part, the extension part 27, and the drop-out prevention part 28 are not provided on both end portions in the longitudinal direction of the securing part 23 provided entirely along the second direction of the panel body 10, referring to FIG. 1A.

The extension part 27 is in the shape of a plate of which thickness dimension is along the thickness dimension of the panel body 10. The width dimension of the extension part 27 along the first direction can be suitably set so as to be easily inserted by the folded part 17*a* through the insertion through hole 29, to be mentioned below, and in view of weight reduction. The extension part 27 is provided so as not to interfere with the panel body 10 of the adjacent ceiling panel 1 to be provided in the first direction. The figures exemplify that the downward face of the extension part 27 is approximately on the same plane as the back face 10*a* of the panel body 10. Namely, the downward face of the extension part 27 is approximately on the same plane as the face of the base portion 21 on the panel body 10 side.

The dimension of the drop-out prevention part 28 from the securing part 23 along the vertical direction is set to be larger than the protruding dimension of the hooked part 26 in such a manner that the upper end of the drop-out prevention part 28 is positioned upward further than the upper end of the hooked part 26. The figures exemplify that the drop-out prevention part 28 is provided with a plurality of long holes spaced in the second direction like the base portion 21 and the securing part 23, the diameter of the long hole being long in the second direction, referring to FIG. 3A. In such a constitution, when a base is provided at the middle region of the ceiling panel 1 in the second direction for attaching equipment or for reinforcement, the region of the drop-out prevention part 28 interfering with the base is easily excised.

Figure 5A:
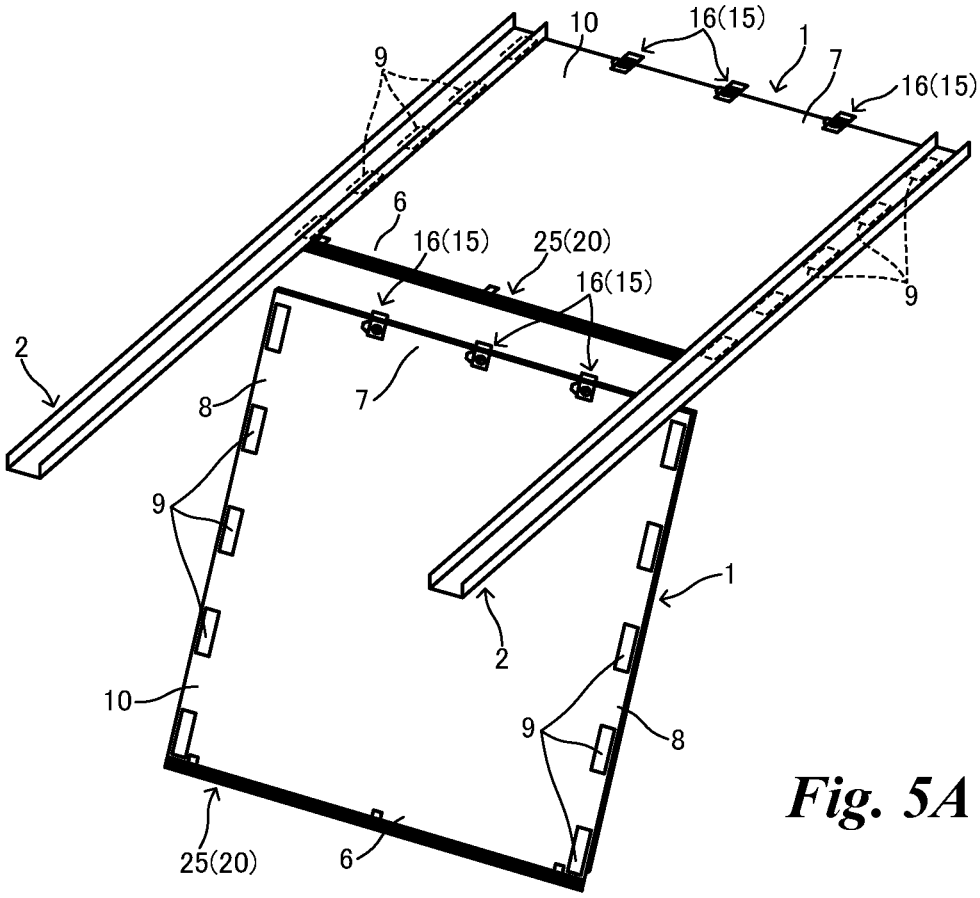
FIG. 5A is a schematic perspective view diagrammatically illustrating one example of a construction procedure of the ceiling panel, and FIG. 5B diagrammatically illustrates one example of the construction procedure and is a partially broken schematic longitudinal sectional view corresponding to FIG. 2B.
Figure 5B:
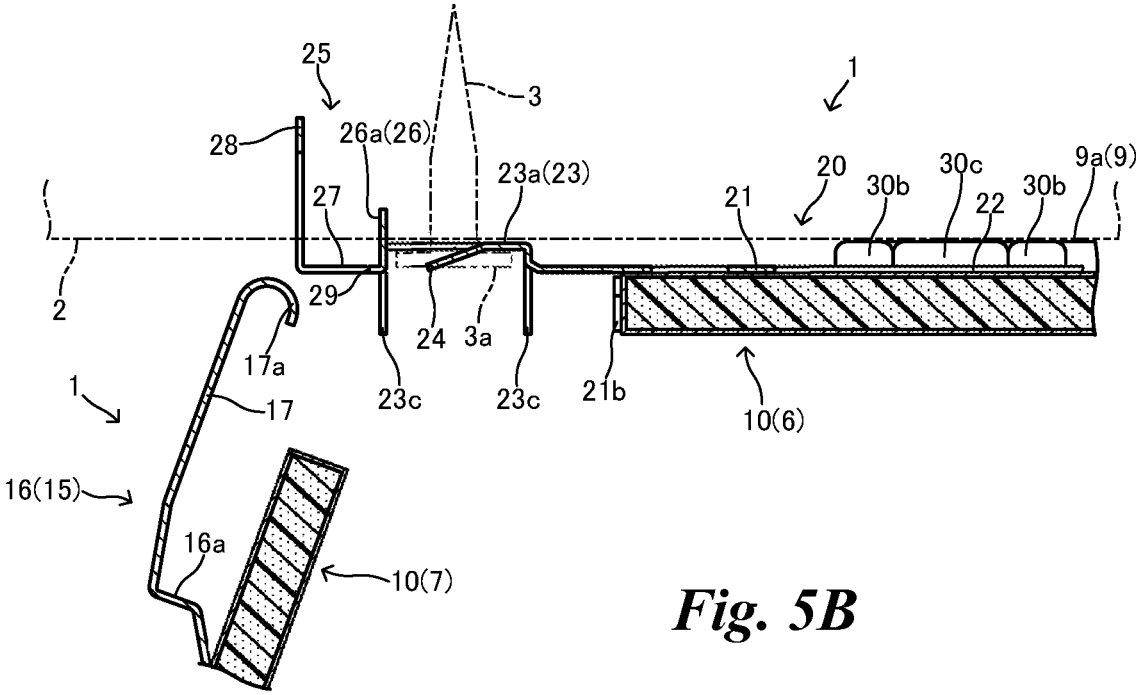

The insertion through hole 29 is provided over the drop-out prevention part 28 and the extension part 27 as illustrated in FIG. 3A and FIG. 5B. Namely, the insertion through hole 29 is successively provided so as to penetrate the outside region of the extension part 27 in the first direction and the downward region of the drop-out prevention part 28. The insertion through hole 29 is provided at a plurality of positions (three in the figures) spaced in the second direction along the first end portion 6 of the panel body 10 so as to be positioned corresponding to the hooked portion 26.

The dimension of the insertion through hole 29 along the second direction is larger than the dimension of the extension portion 17 and the folded portion 17*a* of the hooking portion 16 along the second direction.

The dimension of the insertion through hole 29 along the vertical direction can be suitably set in such a manner that the insertion through hole 29 hardly interferes with the hooking portion 16 of the adjacent ceiling panel 1 to be provided in the first direction. The figures exemplify that the insertion through hole 29 is provided in such a manner that the upper end open edge portion of the insertion through hole 29 on the downward side is positioned upward further than the upper face of the hooking portion 16.

The dimension of the insertion through hole 29 along the first direction can be suitably set in view of the insertion performance of the folded part 17*a*. The figures exemplify that the insertion through hole 29 is provided along the extension part 27 in the first direction almost entirely. The drop-out prevention part 28 and the insertion through hole 29 are not always necessary.

The reinforcement member 20 as constituted above can be successively formed with a suitable metallic material by a press working or a bending procedure. The reinforcement member 20 is not always required for the first end portion 6 close to the wall of the ceiling panel 1 provided close to the wall.

Next explained is an example of a construction procedure of the ceiling panel 1 as constituted above.

As illustrated in FIG. 5A and FIG. 5B, the constructed ceiling panel 1 is held by the ceiling bases 2, 2 provided with the held end portions 8, 8 on both sides in the second direction with a space in the second direction, and the first end portion 6 is fixed to the ceiling bases 2, 2 by the fastener 3 through the securing part 23. The second end portion 7 of the constructed ceiling panel 1 can be fixed to a suitable base close to the wall or to an object to be fixed by several fixing manners.

The unconstructed ceiling panel 1 held in approximately perpendicular or obliquely with the second end portion 7 being upward is moved from below relative to the first end portion 6 of the ceiling panel 1 constructed as mentioned above. As illustrated in FIG. 6A and FIG. 6B, the hooking portion 16 of the unconstructed ceiling panel 1 is inserted into the insertion through hole 29 of the constructed ceiling panel 1, and the folded part 17*a* is hooked on the hooked part 26 of the constructed ceiling panel 1. In such a constitution, depending on the height of the ceiling, the second end portion 7 of the unconstructed ceiling panel 1 is held on the first end portion 6 of the constructed ceiling panel 1 without requiring operations at a high place using a stepladder or the like when a person stands on the floor.

As illustrated with two-dotted lines in FIG. 6B, the unconstructed ceiling panel 1 is turned so as to be approximately horizontal around the folded part 17*a* as a fulcrum so as to raise the first end portion 6 side. Then, the unconstructed ceiling panel 1 is moved so as to be pushed toward the close side in the first direction relative to the constructed ceiling panel 1, and the abutting face 16*a* of the unconstructed ceiling panel 1 is abutted on the abutted face 26*a* of the constructed ceiling panel 1, referring to FIG. 2B.

When the constructed ceiling panel 1 is provided in the second direction, the end face of the held end portion 8 on the second end portion 7 side of the unconstructed ceiling panel 1 is abutted on the abutting part 23*c* of the constructed ceiling panel 1 to be faced. The third abutting part 21*c* of the first end portion 6 of the unconstructed ceiling panel 1 is abutted on the end face of the held end portion 8 of the constructed ceiling panel 1 to be faced.

The magnets 9, 9 of the held end portions 8, 8 on both sides of the unconstructed ceiling panel 1 in the second direction are attracted to the ceiling bases 2, 2. The unconstructed ceiling panel 1 can be positioned in the first direction and the second direction with the magnets 9, 9 of the held end portions 8, 8 attracted to the ceiling bases 2, 2.

The securing part 23 of the first end portion 6 of the unconstructed ceiling panel 1 is fixed to the ceiling bases 2, 2 by the fastener 3. A plurality of ceiling panels 1 can be sequentially constructed so as to be positioned adjacent to each other in lengthwise and breadthwise in the same manner. The above-mentioned construction procedure is only an example and is modified in several ways.

The embodiment exemplifies that the gap-like joint is formed between the ceiling panels 1, 1 adjacent to each other in the first direction and also between the ceiling panels 1, 1 adjacent to each other in the second direction; however, the gaps are not always required in one or both of them. Namely, the end faces of the ceiling panels 1, 1 adjacent to each other can be abutted. In such a case, the abutting face 16*a*, the abutted face 26*a*, the abutting part 23*c* and the third abutting part 21*c*, as mentioned above, can be suitably modified in position, and a constitution without such a positioning portion can be applied.

The embodiment exemplifies that the hooked portion 25 and the fastening part 23 are provided for the reinforcement member 20 which is provided for almost entirely along the first end portion of the panel body 10 in the second direction; however, one of or both of the hooked portion and the securing part are not always necessary for the reinforcement member 20. The reinforcement member 20 is not always required. In such a case, the hooked portion 25 and the fastening part 23 can be respectively provided for the first end portion 6 of the panel body 10.

The embodiment exemplifies that the held end portions 8, 8 on both sides in the second direction are held on the ceiling bases 2, 2 by the magnets 9, 9; however, the held end portions 8, 8 can be fixed to the ceiling bases 2, 2 by a suitable fastener in addition to or in place of the magnets 9, 9.

The embodiment exemplifies that the hooked portion 25 has the hooked part 26 protruding in the thickness direction of the panel body 10; however, the embodiment is not limited to such an exemplification and the hooked portion 25 can be in the shape of a locking hole into which the holing portion 16 is inserted. The hooked portion 25 on which the hooking portion 16 is hooked can be variously modified. The constitution of the ceiling panels 1, 1A in the embodiment is not limited to the embodiments mentioned above, and can be variously modified.

REFERENCE SIGNS LIST

1, 1A ceiling panel
6 first end portion (first end portion in first direction)
7 second end portion (second end portion in first direction)
8 held end portion (end portion in second direction)
10 panel body
10*a* back face
16 hooking portion
16*a* abutting face
17 extension portion
17*a* folded part
20 reinforcement member
25 hooked portion
26 hooked part
26*a* abutted face
28 drop-out prevention part
29 insertion through hole
2 ceiling base

The invention claimed is:

1. A ceiling panel of which both end portions in a second direction are held on a ceiling base having a long shape extending in a first direction and being provided in parallel spaced in the second direction orthogonal to the first direction, the ceiling panel comprising:

a panel body in a shape of a rectangular flat plate;

a hooked portion provided at a first end portion of the panel body in the first direction;

a hooking portion to hook on the hooked portion of an adjacent ceiling panel to be provided in the first direction, the hooking portion being provided at a second end portion of the panel body in the first direction; and a securing part provided so as to protrude from a back face side of the first end portion of the panel body in the first direction to outside in the first direction and fixed on the ceiling base from below, wherein the hooking portion has a folded part that is formed by being bent into a room side from a tip end portion in an extending direction of an extension portion extending outward in the first direction from the second end portion of the panel body in the first direction, and by being further folded inward in the first direction, and wherein the hooked portion keeps hooking and holding of the folded part of the ceiling panel with the second end portion in the first direction of an adjacent ceiling panel to be provided in the first direction being positioned upward further than the first end portion in the first direction.

2. The ceiling panel according to claim 1, wherein an abutting face is provided on a base end side of the hooking portion so as to face the folded part, the abutting face abutting on an abutted face provided at the hooked portion of an adjacent ceiling panel to be provided in the first direction and restricting movement of the ceiling panels adjacent to each other to a close side in the first direction.

3. The ceiling panel according to claim 1, wherein the hooked portion is in a shape of a plate of which thickness direction is along the first direction, and wherein the hooked portion comprises a hooked part to which the folded part is hooked and a drop-out prevention part provided in parallel with the hooked part so as to be disposed outward in the first direction further than the hooked part, the drop-out prevention part being provided with an insertion through hole to which the folded part is inserted.

4. The ceiling panel according to claim 1, further comprising:

a reinforcement member fixed along the second direction almost entirely so as to be disposed along a back face of the first end portion of the panel body in the first direction, wherein the hooked portion is provided at the reinforcement member.

5. The ceiling panel according to claim 2, wherein the hooked portion is in a shape of a plate of which thickness direction is along the first direction, and wherein the hooked portion comprises a hooked part to which the folded part is hooked and a drop-out prevention part provided in parallel with the hooked part so as to be disposed outward in the first direction further than the hooked part, the drop-out prevention part being provided with an insertion through hole to which the folded part is inserted.

6. The ceiling panel according to claim 2, further comprising:

a reinforcement member fixed along the second direction almost entirely so as to be disposed along a back face of the first end portion of the panel body in the first direction, wherein the hooked portion is provided at the reinforcement member.

7. The ceiling panel according to claim 3, further comprising:

a reinforcement member fixed along the second direction almost entirely so as to be disposed along a back face of the first end portion of the panel body in the first direction, wherein the hooked portion is provided at the reinforcement member.

8. The ceiling panel according to claim 5, further comprising:

a reinforcement member fixed along the second direction almost entirely so as to be disposed along a back face of the first end portion of the panel body in the first direction, wherein the hooked portion is provided at the reinforcement member.

9. A ceiling panel of which both end portions in a second direction are held on a ceiling base having a long shape extending in a first direction and being provided in parallel spaced in the second direction orthogonal to the first direction, the ceiling panel comprising:

a panel body in a shape of a rectangular flat plate;

a hooked portion provided at a first end portion of the panel body in the first direction; and a hooking portion to hook on the hooked portion of an adjacent ceiling panel to be provided in the first direction, the hooking portion being provided at a second end portion of the panel body in the first direction, wherein the hooking portion has a folded part that is formed by being bent into a room side from a tip end portion in an extending direction of an extension portion extending outward in the first direction from the second end portion of the panel body in the first direction, and by being further folded inward in the first direction, wherein the hooked portion keeps hooking and holding of the folded part of the ceiling panel with the second end portion in the first direction of an adjacent ceiling panel to be provided in the first direction being positioned upward further than the first end portion in the first direction, wherein the hooked portion is in a shape of a plate of which thickness direction is along the first direction, and wherein the hooked portion comprises a hooked part to which the folded part is hooked and a drop-out prevention part provided in parallel with the hooked part so as to be disposed outward in the first direction further than the hooked part, the drop-out prevention part being provided with an insertion through hole to which the folded part is inserted.

10. A ceiling panel of which both end portions in a second direction are held on a ceiling base having a long shape extending in a first direction and being provided in parallel spaced in the second direction orthogonal to the first direction, the ceiling panel comprising:

a panel body in a shape of a rectangular flat plate;

a hooked portion provided at a first end portion of the panel body in the first direction;

a hooking portion to hook on the hooked portion of an adjacent ceiling panel to be provided in the first direction, the hooking portion being provided at a second end portion of the panel body in the first direction; and a reinforcement member fixed along the second direction almost entirely so as to be disposed along a back face of the first end portion of the panel body in the first direction, wherein the hooked portion is provided at the reinforcement member, wherein the hooking portion has a folded part that is formed by being bent into a room side from a tip end portion in an extending direction of an extension portion extending outward in the first direction from the second end portion of the panel body in the first direction, and by being further folded inward in the first direction, and wherein the hooked portion keeps hooking and holding of the folded part of the ceiling panel with the second end portion in the first direction of an adjacent ceiling panel to be provided in the first direction being positioned upward further than the first end portion in the first direction.

* * * * *